US009395647B2

(12) United States Patent
Tsukamura

(10) Patent No.: US 9,395,647 B2
(45) Date of Patent: Jul. 19, 2016

(54) IMAGE FORMING APPARATUS AND METHOD OF CONTROLLING THE SAME

(71) Applicant: Konica Minolta, Inc., Chiyoda-ku, Tokyo (JP)

(72) Inventor: Shinichi Tsukamura, Yamanashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/698,309

(22) Filed: Apr. 28, 2015

(65) Prior Publication Data

US 2015/0331357 A1 Nov. 19, 2015

(30) Foreign Application Priority Data

May 14, 2014 (JP) ..... 2014-100728

(51) Int. Cl.
*G03G 15/00* (2006.01)
*G03G 15/08* (2006.01)
*G03G 21/00* (2006.01)

(52) U.S. Cl.
CPC ..... *G03G 15/0848* (2013.01); *G03G 15/0844* (2013.01); *G03G 21/0041* (2013.01); *G03G 21/0094* (2013.01)

(58) Field of Classification Search
CPC ..... G03G 15/0848; G03G 15/0844; G03G 21/0041; G03G 21/0094
USPC ..... 399/53, 257, 71, 346
See application file for complete search history.

(56) References Cited

U.S. PATENT DOCUMENTS

2011/0268463 A1* 11/2011 Kimura ..... G03G 21/0005 399/53

FOREIGN PATENT DOCUMENTS

| | | | |
|---|---|---|---|
| JP | 2000-206744 A | | 7/2000 |
| JP | 2003-076079 A | | 3/2003 |
| JP | 2005-043388 A | | 2/2005 |
| JP | 2011-059361 A | * | 3/2011 |

* cited by examiner

*Primary Examiner* — Sophia S Chen
(74) *Attorney, Agent, or Firm* — Buchanan Ingersoll & Rooney PC

(57) ABSTRACT

An image forming apparatus includes: an image bearing member on which a toner image is formed; an image forming section configured to form the toner image by attaching toner mixed with lubricant to the image bearing member, and transfer the toner image formed on the image bearing member to a sheet; a computing section configured to compute a time average value of a coverage of the toner image transferred to the sheet by the image forming section for each of a plurality of different time periods; and a control section configured to control the image forming section to form a toner image of a pattern for forcible toner ejection on the image bearing member in accordance with a result of computing of the computing section.

12 Claims, 8 Drawing Sheets

| | | SECOND TIME AVERAGE VALUE [%] | | | |
|---|---|---|---|---|---|
| | | 1.0 OR SMALLER | 2.0 OR SMALLER | 3.5 OR SMALLER | GREATER THAN 3.5 |
| FIRST TIME AVERAGE VALUE [%] | 3.5 OR SMALLER | A | A | A | B |
| | 4.0 OR SMALLER | A | A | B | B |
| | 4.5 OR SMALLER | A | B | B | B |
| | GREATER THAN 4.5 | B | B | B | B |

FIG. 6

| | | SECOND TIME AVERAGE VALUE [%] | | | |
|---|---|---|---|---|---|
| | | 1.0 OR SMALLER | 2.0 OR SMALLER | 3.5 OR SMALLER | GREATER THAN 3.5 |
| FIRST TIME AVERAGE VALUE [%] | 3.5 OR SMALLER | A (100[%]) | A (80[%]) | A (50[%]) | B |
| | 4.0 OR SMALLER | A (80[%]) | A (50[%]) | B | B |
| | 4.5 OR SMALLER | A (50[%]) | B | B | B |
| | GREATER THAN 4.5 | B | B | B | B |

FIG. 8

IMAGE FORMING APPARATUS AND METHOD OF CONTROLLING THE SAME

CROSS REFERENCE TO RELATED APPLICATIONS

This application is entitled to and claims the benefit of Japanese Patent Application No. 2014-100728, filed on May 14, 2014, the disclosure of which including the specification, drawings and abstract is incorporated herein by reference in its entirety.

BACKGROUND OF THE INVENTION

1. Field of the Invention

The present invention relates to an image forming apparatus and a method of controlling the same.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed (development). Further, the toner image is directly or indirectly transferred to a sheet, followed by heating and pressurization, whereby an image is formed on the sheet.

In the above-mentioned image forming apparatus, materials such as remaining toner or the like adhered on the surface of a photoconductor are removed (for cleaning) by bringing a cleaning blade or the like into sliding contact with the surface of the photoconductor on which a toner image is formed. In the case where a photoconductor is cleaned by a blade or the like, in order to reduce the adhering force of toner to the photoconductor and enhance the cleaning performance, a technique is used in which toner mixed with lubricant is applied to attach the lubricant on the surface of the photoconductor.

It is known that the amount of lubricant adhered on the surface of a photoconductor has a large influence on cleaning performance. For example, when the amount of the lubricant decreases, remaining toner or the like more easily adheres to the surface of the photoconductor, and this results in a problem that passing of toner is caused due to the adhered remaining toner that hinders cleaning, and a problem that the edge of the cleaning blade is drawn in the movement direction (rotational direction) of the photoconductor and is thus turned over.

Here, a case where the amount of lubricant decreases is described in detail. Lubricant added in toner has a polarity opposite to the toner (for example, positive polarity) so that it easily adheres to the toner, and thus, during development, a large amount of the lubricant moves to portions (negatively charged white parts) on the surface of the photoconductor where light exposure has not been performed. Therefore, when an image formation process of a low coverage (low coverage rate) is continuously (successively) performed, a large amount of lubricant, relative to the amount of the toner, moves from the developing device to the photoconductor in the state where the amount of the toner supplied to the developing device is small, and thus the lubricant in the developing device may possibly be exhausted. When the lubricant in the developing device is exhausted, there is no lubricant to be attached to the photoconductor, and the amount of the lubricant on the photoconductor is gradually reduced, thus causing the above-mentioned problems.

Under such circumstances, conventionally, a toner image (patch image) of a pattern for forcible toner ejection is formed in a non-image forming region of a photoconductor such that toner mixed with lubricant is additionally supplied to a developing device in the case where a low-coverage image formation process is performed. By forming a toner image of a pattern for forcible toner ejection, the lubricant in the developing device can be prevented from being exhausted, and in turn, the amount of the lubricant on the photoconductor can be prevented from being reduced. It is to be noted that the non-image forming region of the photoconductor is a region between image formation regions which are each used for forming a toner image to be transferred to a sheet, and the non-image forming region is generally called "interval between sheets."

Japanese Patent Application Laid-Open No. 2000-206744 discloses an image forming apparatus that prevents image quality problems such as uneven image density and fogging. In the technique disclosed in Japanese Patent Application Laid-Open No. 2000-206744, before an electrostatic latent image is formed, the image density of an image to be formed to an image bearing member is detected, and when a value thus detected is lower than a desired value, a predetermined electrostatic latent image is formed to forcibly consume the developer in a developing device.

Japanese Patent Application Laid-Open No. 2003-76079 discloses an image forming apparatus that eliminates defects in association with degradation of developer which is caused when a developing device is driven while the toner consumption amount is small. In the technique disclosed in Japanese Patent Application Laid-Open No. 2003-76079, an image area ratio of an image to be imaged and the driving time for development of a developing device are detected, and developer is forcibly consumed in accordance with the image area ratio per unit driving time for development.

Japanese Patent Application Laid-Open No. 2005-43388 discloses a technique for preventing defects such as degradation of image quality due to fatigue and degradation of developer. In the technique disclosed in Japanese Patent Application Laid-Open No. 2005-43388, an image area ratio per unit migration length of a developer bearing member is detected, and forcible consumption of toner is controlled based on results of the detection.

Naturally, even when an image formation process of a low coverage is performed, lubricant in a developing device may not be exhausted. In this case, when a toner image of a pattern for forcible toner ejection is formed in a non-image forming region of a photoconductor, toner is forcibly consumed even when forcible consumption is unnecessary, and thus the toner is wastefully consumed, which is uneconomical and disadvantageous.

The techniques disclosed in Japanese Patent Application Laid-Open Nos. 2000-206744, 2003-76079, and 2005-43388 are merely techniques for preventing defects such as degradation of image quality in association with degradation of a developer, and do not include configurations for solving the above-mentioned problems.

SUMMARY OF THE INVENTION

An object of the present invention is to provide an image forming apparatus and a method of controlling the same which can limit unnecessary consumption of toner while preventing the amount of lubricant on an image bearing member from being reduced.

To achieve the abovementioned object, an image forming apparatus reflecting one aspect of the present invention includes: an image bearing member on which a toner image is formed; an image forming section configured to form the toner image by attaching toner mixed with lubricant to the image bearing member, and transfer the toner image formed on the image bearing member to a sheet; a computing section configured to compute a time average value of a coverage of the toner image transferred to the sheet by the image forming section for each of a plurality of different time periods; and a control section configured to control the image forming section to form a toner image of a pattern for forcible toner ejection on the image bearing member in accordance with a result of computing of the computing section.

Desirably, in the image forming apparatus, the plurality of time periods include an overlapped time period.

Desirably, in the image forming apparatus, the plurality of time periods include no overlapped time period.

Desirably, in the image forming apparatus, the control section controls the image forming section to form the toner image of the pattern for forcible toner ejection in a non-image forming region of the image bearing member.

Desirably, in the image forming apparatus, the control section determines whether to form the toner image of the pattern for forcible toner ejection in accordance with the result of the computing of the computing section.

Desirably, in the image forming apparatus, when forming the toner image of the pattern for forcible toner ejection, the control section controls the image forming section to change an amount of toner of the toner image of the pattern for forcible toner ejection in accordance with the result of the computing of the computing section.

In a method of controlling an image forming apparatus which reflects another aspect of the present invention, the image forming apparatus includes: an image bearing member on which a toner image is formed; and an image forming section configured to form the toner image by attaching toner mixed with lubricant to the image bearing member, and transfer the toner image formed on the image bearing member to a sheet; and the method includes: computing a time average value of a coverage of the toner image transferred to the sheet by the image forming section for each of a plurality of different time periods; and controlling the image forming section to form a toner image of a pattern for forcible toner ejection on the image bearing member in accordance with a result of computing of the computing section.

Desirably, in the method, the plurality of time periods include an overlapped time period.

Desirably, in the method, the plurality of time periods include no overlapped time period.

Desirably, in the method, the image forming section is controlled to form the toner image of the pattern for forcible toner ejection in a non-image forming region of the image bearing member.

Desirably, in the method, whether to form the toner image of the pattern for forcible toner ejection is determined in accordance with the result of the computing of the computing section.

Desirably, in the method, when the toner image of the pattern for forcible toner ejection is formed, the image forming section is controlled to change an amount of toner of the toner image of the pattern for forcible toner ejection in accordance with the result of the computing of the computing section.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 6 is a table showing relationships among a first time average value, a second time average value, and a possibility of exhaustion of lubricant in a developing device;

FIG. 8 is a table showing relationships among the first time average value, the second time average value, and the possibility of exhaustion of the lubricant in the developing device.

DESCRIPTION OF THE PREFERRED EMBODIMENTS

Figure 1:
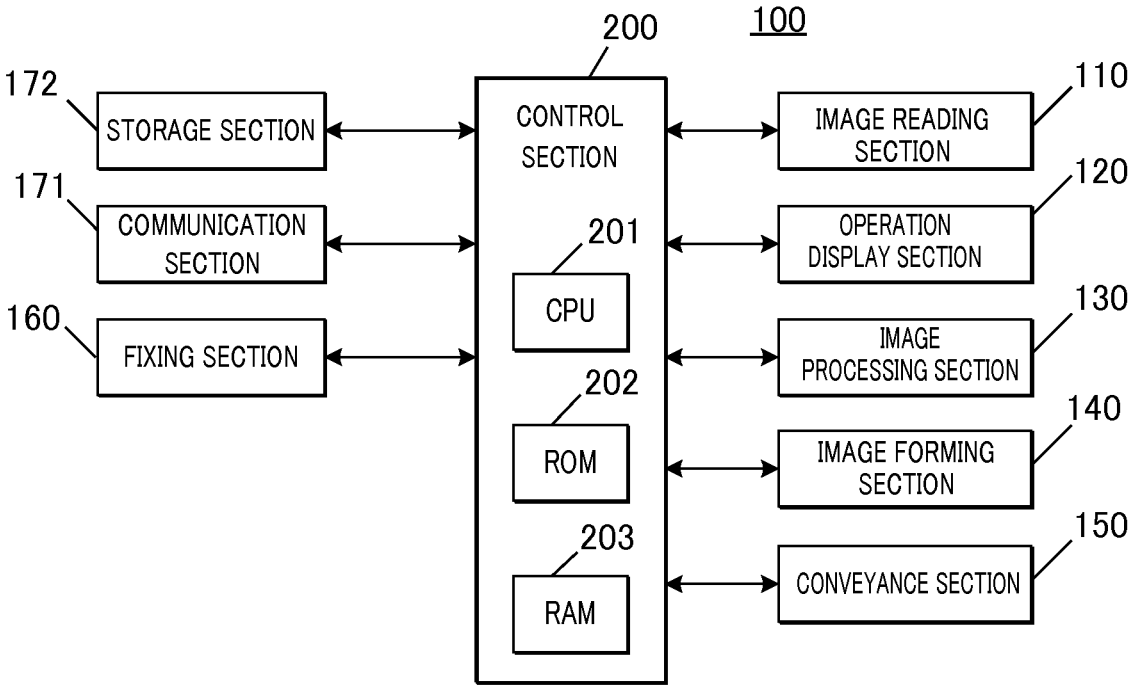
FIG. 1 illustrates a principal part of a control system of an image forming apparatus of the present embodiment.

In the following, the present embodiment is described in detail with reference to the drawings. Image forming apparatus 100 illustrated in FIG. 1 is a so-called monochrome image forming apparatus, and forms a single-color image on a sheet through an electrophotographic process. As illustrated in FIG. 1, image forming apparatus 100 includes image reading section 110, operation display section 120, image processing section 130, image forming section 140, conveyance section 150, fixing section 160 and control section 200. It is to be noted that control section 200 of an embodiment of the present invention functions also as "computing section."

Control section 200 includes Central Processing Unit (CPU) 201, Read Only Memory (ROM) 202, and Random Access Memory (RAM) 203. CPU 201 reads out a program corresponding to the processing to be performed from ROM 202 and loads the program in RAM 203, and controls the operation of each block of image forming apparatus 100 in conjunction with the loaded program. At this time, various kinds of data stored in storage section 172 are referenced. Storage section 172 is composed of a nonvolatile-semiconductor memory (so-called flash memory) or a hard disk drive, for example.

Control section 200 exchanges various kinds of data, via communication section 171, with an external apparatus (for example, a personal computer) connected through a communication network such as local area network (LAN) and wide area network (WAN). For example, control section 200 receives image data sent from the external apparatus, and forms an image on a recording sheet based on the image data. Communication section 171 is composed of, for example, a communication control card such as a LAN card.

Image reading section 110 optically scans a document conveyed onto a contact glass and brings light reflected from a document into an image on a light reception surface of a charge coupled device (CCD) sensor, thereby reading out the image of the document. It is to be noted that, while the document is conveyed onto the contact glass by an automatic document feeder (ADF), the document may be manually placed on the contact glass.

Operation display section 120 includes a touch screen. Users can input various kinds of requests and settings from the touch screen. Pieces of information relating to the requests and settings are handled by control section 200 as printing job information. The printing job information includes sheet size, number of sheets to be printed, and the like. When execution of a printing job is requested from operation display section 120, control section 200 records the image data, sheet size, number of sheets to be printed and the like included in the printing job in storage section 172.

Image processing section 130 includes a circuit for performing analog-to-digital (A/D) conversion processing and a circuit for performing digital image processing. Image processing section 130 performs A/D conversion processing on an analog image signal acquired by a CCD sensor of image reading section 110 to generate digital image data, and outputs the generated digital image data to image forming section 140.

An exposing device of image forming section 140 emits laser light based on the digital image data generated by image processing section 130, and irradiates a photoconductor drum (photoconductor) with the emitted laser light to form an electrostatic latent image on the photoconductor drum (light exposure step).

Image forming section 140 includes configurations for carrying out steps including, in addition to the above-mentioned light exposure step, a charging step that is performed prior to the light exposure step, a development step that is performed after the light exposure step, a transferring step subsequent to the development step, and a cleaning step subsequent to the transferring step. In the charging step, image forming section 140 charges the surface of the photoconductor drum to a polarity opposite to the charging polarity of the toner (for example, negative polarity) by corona discharge from a charging device. In the development step, image forming section 140 causes toner contained in a developer in a developing device to adhere to an electrostatic latent image on the photoconductor drum, and thus forms a toner image on the photoconductor drum.

In the transferring step, image forming section 140 transfers the toner image on the photoconductor drum onto a sheet conveyed by conveyance section 150 when a transfer bias having a polarity opposite to that of the toner is applied from a voltage application section not illustrated. In the cleaning step, image forming section 140 brings a cleaning device such as a brush into contact with the photoconductor drum, to thereby remove toner remaining on the surface of the photoconductor drum that has undergone the transferring step.

Fixing section 160 includes a fixing roller and a pressure roller. The pressure roller is disposed in pressure contact with the fixing roller. A fixing nip portion is formed at a portion where the fixing roller and the pressure roller make pressure contact with each other. Fixing section 160 applies heat and pressure to the toner image formed on the sheet introduced in the fixing nip part (thermal fixation), thereby fixing the toner image to the sheet (fixing step). Thus, a fixed toner image is formed on the sheet. The sheet that has been subjected to thermal fixation by fixing section 160 is ejected from image forming apparatus 100.

Figure 2:
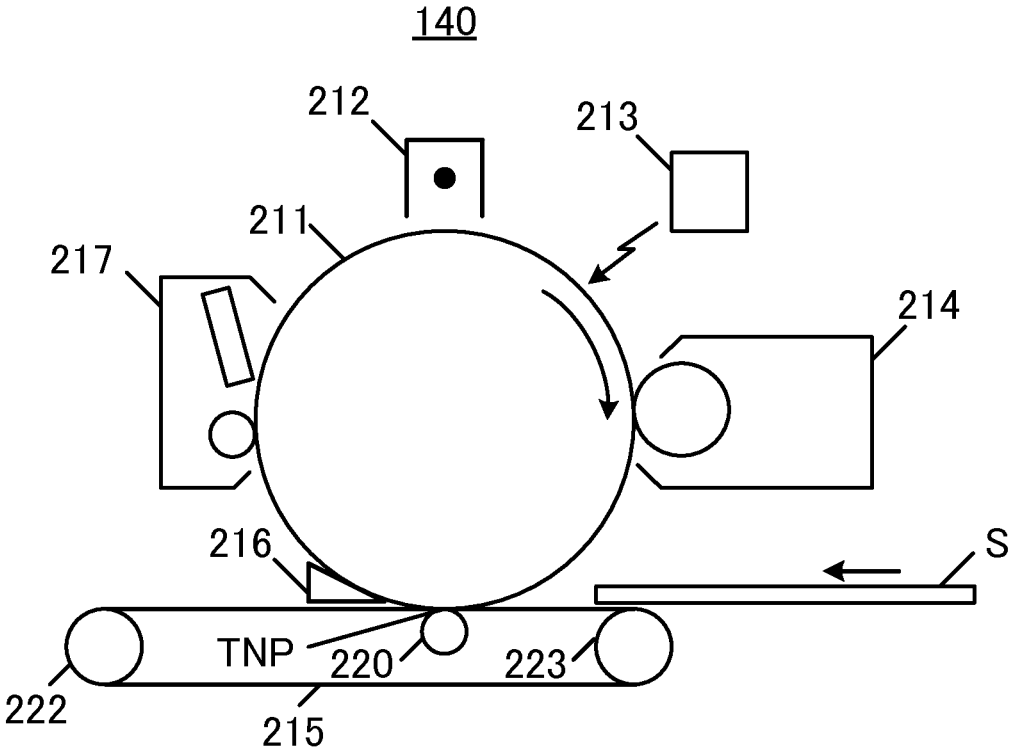
FIG. 2 schematically illustrates a configuration of an image forming section of the present embodiment.

Next, referring to FIG. 2, a configuration of image forming section 140 is described in detail. In FIG. 2, the reference numeral 211 denotes a rotatable photoconductor drum (which functions as the "image bearing member" of the embodiment of the present invention) that bears a toner image, and charging apparatus 212, exposing device 213, developing device 214, transfer belt 215 configured to transfer a toner image formed on photoconductor drum 211 to sheet S, separating claw 216, and cleaning apparatus 217 configured to remove toner remaining on photoconductor drum 211 are provided along the rotational direction (arrow direction) of photoconductor drum 211.

Charging device 212 evenly negatively charges the surface of photoconductor drum 211. Exposure device 213 is composed of, for example, a semiconductor laser, and configured to irradiate photoconductor drum 211 with laser light corresponding to the image. The positive charge is generated in the charge generation layer of photoconductor drum 211 and is transported to the surface of the charge transport layer, whereby the surface charge (negative charge) of photoconductor drum 211 is neutralized. An electrostatic latent image is formed on the surface of photoconductor drum 211 due to a difference in potential from its surroundings.

Developing device 214 is, for example, a two-component development type developing device, and attaches toner to the surface of photoconductor drums 211 to visualize the electrostatic latent image, thereby forming a toner image (development operation). By the amount consumed by this development operation, toner is supplied by a toner supply mechanism not illustrated.

Transfer belt 215 has a two-layer structure made up of a semi-conductive belt base material composed of chloroprene rubber or the like and an insulation layer provided as a surface layer. Transfer belt 215 is installed around driven roller 223, driving roller 222 and other rollers in a stretched state, and is disposed below photoconductor drum 211 in such a manner that the surface of transfer belt 215 is in contact with part of the outer peripheral surface of photoconductor drum 211. That is, transfer nip portion TNP as a transfer region is formed between transfer belt 215 and photoconductor drum 211. Sheet S is conveyed while it is pressed against photoconductor drum 211 by transfer belt 215 at transfer nip portion TNP.

Transfer roller 220 is disposed on the inside of transfer belt 215 that makes contact with a part of the outer peripheral surface of photoconductor drum 211. Transfer roller 220 is connected with a high-voltage power supply (not illustrated) that applies transfer bias. When sheet S passes through transfer nip portion TNP, control section 200 controls the transfer bias to be applied by the high-voltage power supply such that transfer belt 215 has a predetermined transfer potential (positive polarity). When the potential of transfer belt 215 is changed to a positive transfer potential, a negative toner image on photoconductor drum 211 is transferred onto sheet S in contact with photoconductor drum 211. In addition, control section 200 controls transfer bias to be applied by the high-voltage power supply such that transfer belt 215 has a predetermined transfer potential (negative polarity) when no sheet S is passing through transfer nip portion TNP. It is to be noted that, from the viewpoint of reducing the power consumption of the high-voltage power supply, control section 200 may control the high-voltage power supply such that transfer bias is not applied to transfer roller 220 when no sheet S is passing through transfer nip portion TNP.

Separating claw 216 is provided on the downstream side of transfer nip portion TNP of on the upstream side of cleaning apparatus 217 in the rotational direction of photoconductor drum 211. Separating claw 216 is configured to separate sheet S that has passed through transfer nip portion TNP from photoconductor drum 211. A plurality of (three, for example) separating claws 216 are disposed along the rotational axis direction of photoconductor drum 211 in the state where separating claws 216 are in contact with photoconductor drum 211. Separating claws 216 are claw members made of a heat-resistant resin (which have a claw width of 10 [mm], for example), and on the surface of separating claws 216, a surface layer made of a fluorine resin such as PFA and PTFE is formed. While the contacting pressure of separating claws 216 on photoconductor drum 211 is dependent on the claw width, the material of the claws, and the material of the surface of photoconductor drum 211, the contacting pressure may has any value as long as photoconductor drum 211 is not damaged.

Cleaning apparatus 217 includes a cleaning blade that is brought into sliding contact with the surface of photoconductor drum 211 and the like, and removes (eliminates) materials such as remaining toner adhered on the surface of photoconductor drum 211 after the transfer.

In the present embodiment, when photoconductor drum 211 is cleaned with use of the cleaning blade and the like, toner mixed with lubricant is applied and the lubricant is attached on the surface of photoconductor drum 211 to reduce the adhering force of the toner to photoconductor drum 211 and to enhance the cleaning performance.

The amount of lubricant adhered on the surface of photoconductor drum 211 has a large influence on the cleaning performance. For example, when the amount of the lubricant decreases, remaining toner or the like more easily adheres to the surface of the photoconductor drum 211, and this results in a problem that passing of toner is caused due to the adhered remaining toner that hinders cleaning, and a problem that the edge of the cleaning blade is drawn in the movement direction (rotational direction) of photoconductor drum 211 and is thus turned over.

Here, a case where the amount of lubricant decreases is described in detail. Lubricant added in toner has a polarity opposite to the toner (for example, positive polarity) so that it easily adheres to the toner, and thus, during development by developing device 214, a large amount of the lubricant moves to portions (negatively charged white parts) on the surface of photoconductor drum 211 where light exposure has not been performed. Therefore, when an image formation process of a low coverage (for example, 3.5 [%] or smaller) is continuously (successively) performed, a large amount of lubricant, relative to the amount of the toner, moves from developing device 214 to photoconductor drum 211 in the state where the amount of the toner supplied to developing device 214 is small, and thus the lubricant in the developing device may possibly be exhausted. When the lubricant in developing device 214 is exhausted, there is no lubricant to be attached to photoconductor drum 211, and the amount of the lubricant on photoconductor drum 211 is gradually reduced, thus causing the above-mentioned problems.

Under such circumstances, image forming apparatus 100 forms a toner image (patch image) of a pattern for forcible toner ejection in a non-image forming region of photoconductor drum 211 such that toner mixed with lubricant is additionally supplied to developing device 214 in the case where a low-coverage image formation process is performed.

Figure 3:
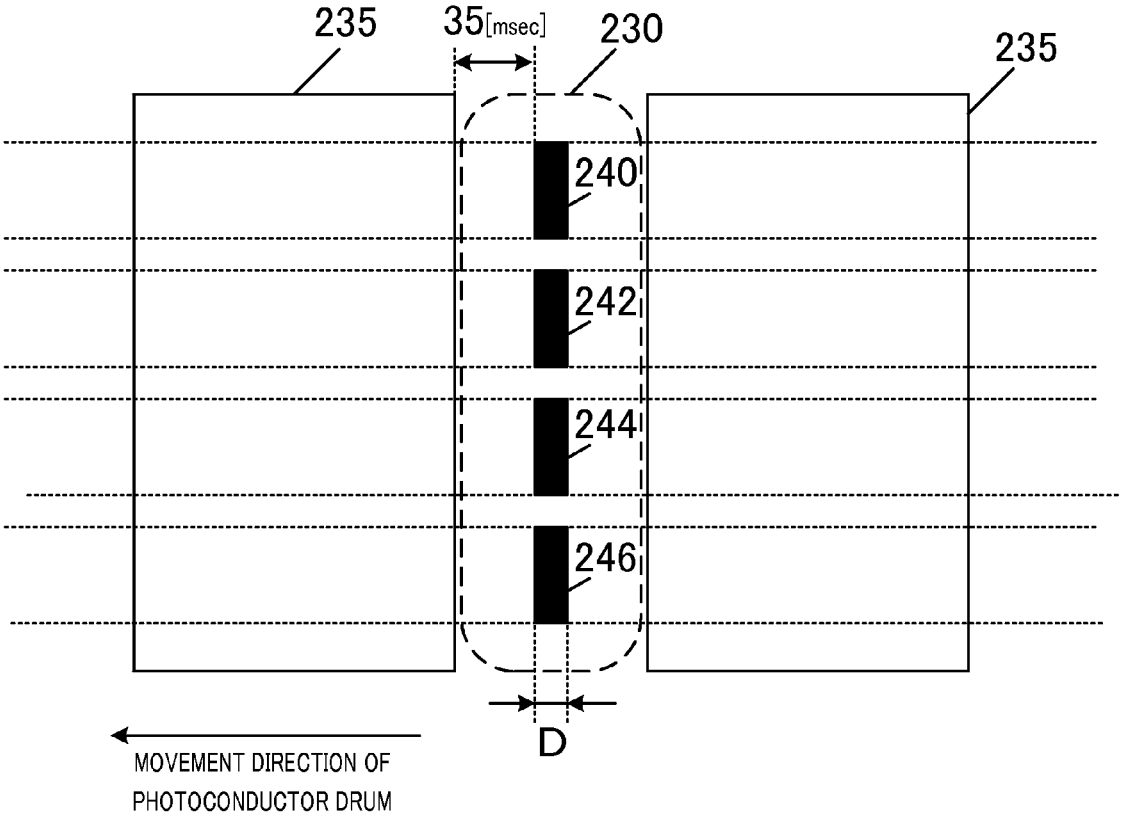
FIG. 3 is an explanatory view of a toner image of a pattern for forcible toner ejection of the present embodiment.

FIG. 3 illustrates a toner image of a pattern for forcible toner ejection. Control section 200 controls the operations of the components and devices illustrated in FIGS. 1 and 2 to form toner images 240, 242, 244 and 246 of the pattern for forcible toner ejection in non-image forming region 230 of photoconductor drum 211. To be more specific, at a position at the time when a predetermined time (for example, 35 [msec]) has passed after the rear end portion of image formation region 235 of photoconductor drum 211 has passed through a development nip portion (a development region that is formed between a developing sleeve of developing device 214 and photoconductor drum 211), control section 200 forms toner images 240 to 246 of the pattern for forcible toner ejection in such a manner as to avoid making contact with separating claw 216 provided in contact with photoconductor drum 211. Although not illustrated in FIG. 3, in the direction orthogonal to the direction along which photoconductor drum 211 moves (the vertical direction in FIG. 3), three separating claws 216 are provided between toner images 240 to 246 of the pattern for forcible toner ejection.

Control section 200 controls the high-voltage power supply to apply transfer bias that sets the potential of transfer belt 215 to a predetermined transfer potential (negative polarity) when toner images 240 to 246 pass through transfer nip portion TNP such that toner images 240 to 246 (negative polarity) of the pattern for forcible toner ejection formed on photoconductor drum 211 are not transferred to transfer belt 215 side. It is to be noted that image formation region 235 is a region where a toner image to be transferred to single sheet S is formed. Non-image forming region 230 is a region (interval between sheets) between image formation regions 235 in each of which a toner image to be transferred to single sheet S is formed.

As illustrated in FIG. 3, toner images 240 to 246 of the pattern for forcible toner ejection are belt-shaped toner images that extend in a direction orthogonal to a direction along which photoconductor drum 211 moves. In this case, the lower the coverage of the toner image that has been formed the last time, the longer the length D (hereinafter also referred to simply as "width") of toner images 240 to 246 of the pattern for forcible toner ejection in the direction along which photoconductor drum 211 moves, that is, the larger the amount of toner of toner images 240 to 246. One reason for this is that the lower the coverage of the formed toner image, the higher the possibility of exhaustion of the lubricant in developing device 214, and therefore, the larger amount of toner mixed with lubricant is required to be supplied to developing device 214.

By forming toner images 240 to 246 of the pattern for forcible toner ejection, the possibility of exhaustion of the lubricant in developing device 214 can be eliminated, and in turn, the possibility of reduction in the amount of the lubricant on photoconductor drum 211 can be eliminated. It is to be noted that, by forming toner images 240 to 246 of the pattern for forcible toner ejection on non-image forming region 230, the productivity of an image formation process corresponding to the printing job can be ensured without stopping the image formation process.

Naturally, even when an image formation process of a low coverage is performed, the lubricant in developing device 214 may not be exhausted. For example, the lubricant in developing device 214 may not be exhausted when an image formation process of low-coverage is performed for a short time after an image formation process of a high coverage has been performed for a long time (that is, after a large amount of toner mixed with lubricant has been additionally supply). At this time, when a toner image of a pattern for forcible toner ejection is formed in non-image forming region 230 of photoconductor drum 211, toner is forcibly consumed even when forcible consumption is unnecessary, and thus toner is wastefully consumed, which is uneconomical and disadvantageous.

In the present embodiment, only under the condition where the possibility of exhaustion of the lubricant in developing device 214 is actually high and the possibility of reduction in the amount of the lubricant on photoconductor drum 211 is high, control section 200 operates to form toner images 240 to 246 of the pattern for forcible toner ejection, that is, to perform forcible consumption of toner.

Figure 4:
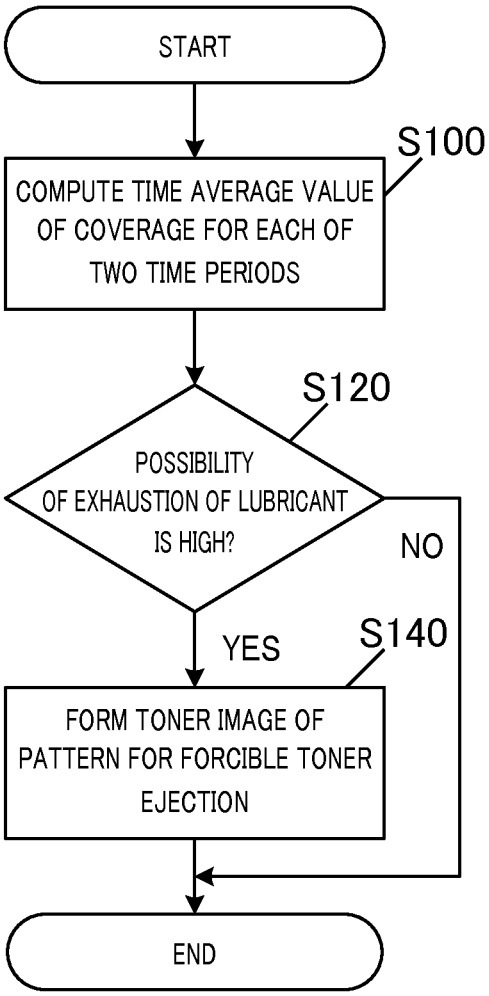
FIG. 4 is a flowchart of an exemplary control operation of the image forming apparatus of the present embodiment.

FIG. 4 is a flowchart of an exemplary control operation of image forming apparatus 100. The process of step S100 is started when control section 200 outputs request to execute a printing job for performing continuous image formation. In addition, processes of steps S100 to S140 are executed every time a predetermined time (for example, 15 [sec]) elapses after the image formation process has been started.

First, on the basis of digital image data generated by image processing section 130, control section 200 computes the time average value of the coverage of the toner image transferred to sheet S by image forming section 140 for each of two different time periods prior to the process of step S100 (step S100). The coverage of a toner image is the output ratio to the entire surface output 100[%] in the effective image formation region of sheet S, and is also called "image coverage" or "coverage rate."

Figure 5A:
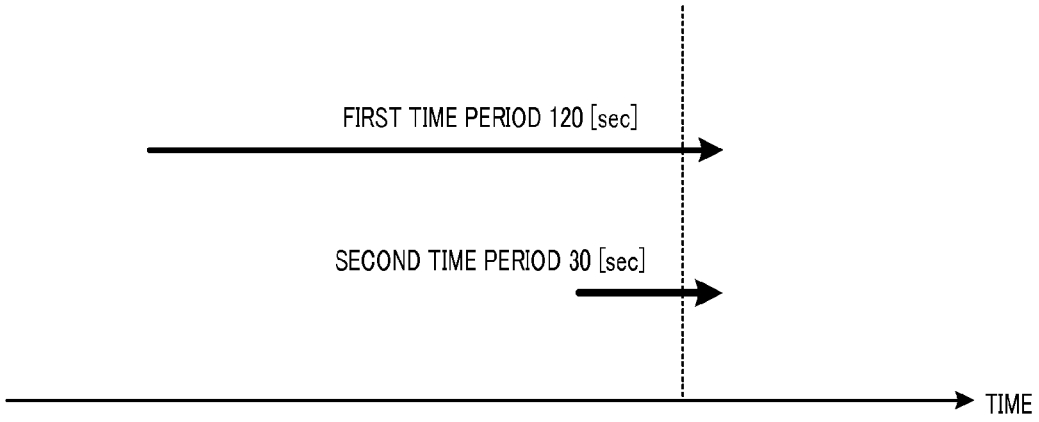
FIGS. 5A and 5B are explanatory views of a first time period and a second time period of the present embodiment.
Figure 5B:
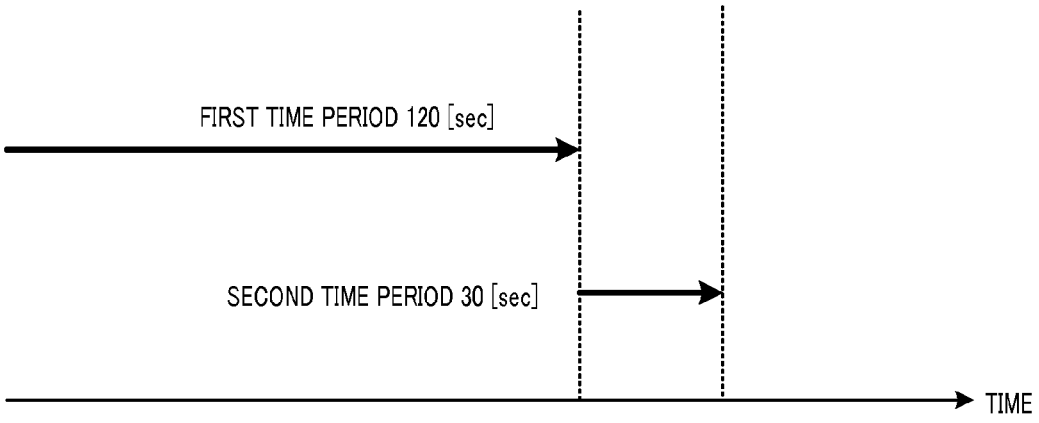

In the present embodiment, as illustrated in FIG. 5A, two time periods for which the time average value of the coverage is computed are a first time period having a time length of 120 [sec], and a second time period having a time length of 30 [sec] which is shorter than the first time period. Between the first time period and the second time period, an overlapped time period (time length: 30 [sec]) is provided. In the first time period, control section 200 computes a time average value of the coverage of the toner image transferred by image forming section 140 to sheet S as a first time average value. In addition, in the second time period, control section 200 computes a time average value of the coverage of the toner image transferred by image forming section 140 to sheet S as a second time average value. It is to be noted that, as illustrated in FIG. 5B, the overlapped time period may not be provided between the first time period and the second time period. In this case, the first time period and the second time period may either be continuous or not. In addition, the time lengths of the first time period and the second time period time may either be identical to each other or different from each other.

Next, on the basis of results computed at step S100, control section 200 determines whether the possibility of exhaustion of the lubricant in developing device 214, that is, the possibility of reduction in the amount of the lubricant on photoconductor drum 211 is high (step S120). When it is determined that the possibility of exhaustion of the lubricant in developing device 214 is high (step S120, YES), control section 200 forms toner images 240, 242, 244 and 246 of the pattern for forcible toner ejection in non-image forming region 230 of photoconductor drum 211 as illustrated in FIG. 3 (step S140). On the other hand, when the possibility of exhaustion of the lubricant in developing device 214 is not high (step S120, NO), image forming apparatus 100 terminates the processes in FIG. 4.

In the present embodiment, control section 200 determines whether the possibility of exhaustion of the lubricant in developing device 214 is high in accordance with a table of FIG. 6. The table of FIG. 6 shows relationships among the first time average value, the second time average value computed at step S100, and the possibility of exhaustion of the lubricant. When the item corresponding to the first time average value and the second time average value is "A," the possibility of exhaustion of the lubricant is high, and therefore toner images 240, 242, 244 and 246 of the pattern for forcible toner ejection are required to be formed. When the item corresponding to the first time average value and the second time average value is "B," the possibility of exhaustion of the lubricant is not high, and toner images 240, 242, 244 and 246 of the pattern for forcible toner ejection are not required to be formed. For example, when the first time average value and the second time average value are 3.7[%] and 1.8[%], respectively, control section 200 determines that the possibility of exhaustion of the lubricant is high. When the first time average value and the second time average value are 4.3[%] and 3.7[%], respectively, control section 200 determines that the possibility of exhaustion of the lubricant is not high.

The possibility of exhaustion of the lubricant (that is, the necessity to form toner images 240, 242, 244 and 246 of the pattern for forcible toner ejection) is determined in accordance with illustrated in FIG. 6, and thus, only under the condition where the possibility of exhaustion of the lubricant in developing device 214 is actually high and the possibility of reduction in the amount of the lubricant on photoconductor drum 211 is high, toner images 240 to 246 of the pattern for forcible toner ejection is formed, that is, forcible consumption of toner is executed. In this manner, the amount of lubricant on photoconductor drum 211 can be prevented from being reduced, and unnecessary consumption of toner can be limited.

Figure 7:
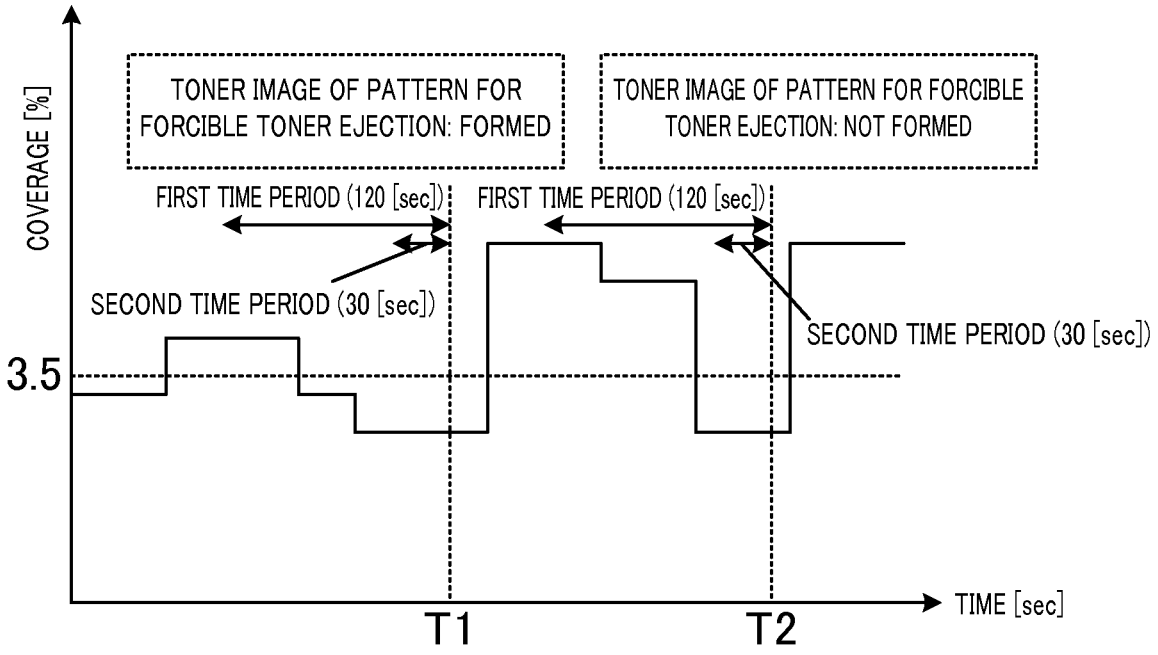
FIG. 7 illustrates time variation of a coverage in an image formation process of the present embodiment.

FIG. 7 illustrates time variation of the coverage during an image formation process corresponding to a printing job. For example, in the case where the first time average value and the second time average value are computed at a time point when the execution time of the image formation process reaches T1, since the second time average value is 3.5[%] or smaller and the first time average value is 3.5 [%] or smaller, control section 200 determines that the possibility of exhaustion of the lubricant in developing device 214 is high, and forms toner images 240, 242, 244 and 246 of the pattern for forcible toner ejection. In the case where the first time average value and the second time average value are computed at a time point when the execution time of the image formation process reaches T2 (that is, in the case where a low-coverage image formation process is performed for a short time period after the high coverage image formation process has been performed for a long period of time), since the first time average value is greater than 3.5 [%] although the second time average value is 3.5 [%] or smaller, control section 200 determines that the possibility of exhaustion of the lubricant in developing device 214 is not high, and does not form the toner images 240, 242, 244 and 246 of the pattern for forcible toner ejection.

Control section 200 may determine the possibility of exhaustion of the lubricant in accordance with the table of FIG. 8 instead of the table of FIG. 6, and may change the widths of toner images 240, 242, 244 and 246 of the pattern for forcible toner ejection when it is determined that the possibility of exhaustion of the lubricant is high. The table of FIG. 8 shows not only relationships among the computed first time average value, the computed second time average value, and the possibility of exhaustion of the lubricant, but also widths, which are each shown as a width rate relative to a predetermined width (for example, 20[mm]) as 100[%], of toner images 240, 242, 244 and 246 of the pattern for forcible toner ejection which are required to be formed when the possibility of exhaustion of the lubricant is high. For example, when the first time average value and the second time average value are 3.7[%] and 1.8[%], respectively, control section 200 determines that the possibility of exhaustion of the lubricant is high, and forms toner images 240, 242, 244 and 246 of the pattern for forcible toner ejection whose width is 50[%] of a predetermined width, that is, 10 [mm]. In addition, when the first time average value and the second time average value are 3.0[%] and 0.8[%], respectively, control section 200 determines that the possibility of exhaustion of the lubricant is high, and forms toner images 240, 242, 244 and 246 of the pattern for forcible toner ejection whose width is 100[%] of a predetermined width (for example, 20 [mm]), that is 20 [mm]. By changing the widths of toner images 240, 242, 244 and 246 of the pattern for forcible toner ejection depending on the first time average value and the second time average value, the required amount of toner of toner images 240, 242, 244 and 246 can be finely controlled in accordance with the possibility of exhaustion of the lubricant in developing device 214, and thus unnecessary consumption of toner can be limited more accurately. Alternatively, the amount of toner of toner images 240, 242, 244 and 246 may be changed by changing the shape, not the width, of toner images 240, 242, 244 and 246 of the pattern for forcible toner ejection.

As has been described in detail, in the present embodiment, image forming apparatus 100 includes: photoconductor drum 211 on which toner image is formed; image forming section 140 configured to form the toner image by attaching toner mixed with lubricant to photoconductor drum 211, and transfer the toner image formed on photoconductor drum 211 to sheet S; a computing section (control section 200) configured to compute a time average value of a coverage of the toner image transferred to sheet S by image forming section 140 for each of a plurality of different time periods; and control section 200 configured to control image forming section 140 to form toner images 240 to 246 of the pattern for forcible toner ejection on photoconductor drum 211 in accordance with a result of computing of the computing section.

According to the above-mentioned configuration of the present embodiment, only under the condition where the possibility of exhaustion of the lubricant in developing device 214 is actually high and the possibility of reduction in the amount of the lubricant on photoconductor drum 211 is high, toner images 240 to 246 of the pattern for forcible toner ejection are formed, that is, forcible consumption of toner is executed. Thus, the amount of lubricant on photoconductor drum 211 can be prevented from being reduced, and unnecessary consumption of toner can be limited.

While image forming apparatus 100 is a monochrome image forming apparatus in the above-mentioned embodiment, image forming apparatus 100 may be a color image forming apparatus.

While the time average value of the coverage of the toner image transferred to sheet S by image forming section 140 is computed for each of the two different time periods, and toner images 240 to 246 of the pattern for forcible toner ejection are formed in accordance with results of the computing in the above-mentioned embodiment, the present invention is not limited to this. For example, the time average value of the coverage of the toner image transferred to sheet S by image forming section 140 may be computed for each of different three or more time periods, and toner images 240 to 246 of the pattern for forcible toner ejection may be formed in accordance with computed results.

The embodiments disclosed herein are merely exemplifications and should not be considered as limitative. While the invention made by the present inventor has been specifically described based on the preferred embodiments, It is not intended to limit the present invention to the above-mentioned preferred embodiments but the present invention may be further modified within the scope and spirit of the invention defined by the appended claims.

The invention claimed is:

1. An image forming apparatus comprising:

an image bearing member on which a toner image is formed;

an image forming section configured to form the toner image by attaching toner mixed with lubricant to the image bearing member, and transfer the toner image formed on the image bearing member to a sheet;

a computing section configured to compute a time average value of a coverage of the toner image transferred to the sheet by the image forming section for each of a plurality of different time periods; and a control section configured to control the image forming section to form a toner image of a pattern for forcible toner ejection on the image bearing member in accordance with a result of computing of the computing section, wherein the plurality of different time periods comprise a first time period averaged to determine a first time average value and a second time period averaged to determine a second time average value, and the control section determines the relationship between the first time average value and the second average value, and controls the image forming section to form the toner image of the pattern for forcible toner ejection based on the relationship between the first time average value and the second average value.

2. The image forming apparatus according to claim 1, wherein the plurality of time periods include an overlapped time period.

3. The image forming apparatus according to claim 1, wherein the plurality of time periods include no overlapped time period.

4. The image forming apparatus according to claim 1, wherein the control section controls the image forming section to form the toner image of the pattern for forcible toner ejection in a non-image forming region of the image bearing member.

5. The image forming apparatus according to claim 1, wherein the control section determines whether to form the toner image of the pattern for forcible toner ejection in accordance with the result of the computing of the computing section.

6. The image forming apparatus according to claim 5, wherein when forming the toner image of the pattern for forcible toner ejection, the control section controls the image forming section to change an amount of toner of the toner image of the pattern for forcible toner ejection in accordance with the result of the computing of the computing section.

7. A method of controlling an image forming apparatus, the image forming apparatus including:

an image bearing member on which a toner image is formed; and an image forming section configured to form the toner image by attaching toner mixed with lubricant to the image bearing member, and transfer the toner image formed on the image bearing member to a sheet;

the method comprising:

computing a time average value of a coverage of the toner image transferred to the sheet by the image forming section for each of a plurality of different time periods; and controlling the image forming section to form a toner image of a pattern for forcible toner ejection on the image bearing member in accordance with a result of computing of the computing section, wherein the plurality of different time periods comprise a first time period averaged to determine a first time average value and a second time period averaged to determine a second time average value, and the relationship between the first time average value and the second average value is determined, and the toner image of the pattern for forcible toner ejection is formed based on the relationship between the first time average value and the second average value.

8. The method according to claim 7, wherein the plurality of time periods include an overlapped time period.

9. The method according to claim 7, wherein the plurality of time periods include no overlapped time period.

10. The method according to claim 7, wherein the image forming section is controlled to form the toner image of the pattern for forcible toner ejection in a non-image forming region of the image bearing member.

11. The method according to claim 7, wherein whether to form the toner image of the pattern for forcible toner ejection is determined in accordance with the result of the computing of the computing section.

12. The method according to claim 11, wherein when the toner image of the pattern for forcible toner ejection is formed, the image forming section is controlled to change an amount of toner of the toner image of the pattern for forcible toner ejection in accordance with the result of the computing of the computing section.

* * * * *